US006214143B1

(12) United States Patent
Robertson et al.

(10) Patent No.: US 6,214,143 B1
(45) Date of Patent: Apr. 10, 2001

(54) METHOD AND APPARATUS FOR FORMING A UNIFORM BLANKET OF SYNTHETIC OR GLASS FIBERS

(75) Inventors: John Stuart Robertson, Littleton; Michael Dean Peterson, Parker, both of CO (US)

(73) Assignee: Johns Mansville International, Inc., Denver, CO (US)

( * ) Notice: Subject to any disclaimer, the term of this patent is extended or adjusted under 35 U.S.C. 154(b) by 0 days.

(21) Appl. No.: 08/242,220

(22) Filed: May 13, 1994

(51) Int. Cl.[7] ..... B65H 69/02
(52) U.S. Cl. ..... 156/158; 156/147; 156/169
(58) Field of Search ..... 428/224, 59, 299; 156/62.8, 147, 158, 265, 309.6, 311, 324, 325, 166, 169, 176, 181

(56) References Cited

U.S. PATENT DOCUMENTS 4,112,159 * 9/1978 Pall ..... 428/36
4,116,738 * 9/1978 Pall ..... 156/167
4,594,202 * 6/1986 Pall et al. ..... 264/8
4,648,920 * 3/1987 Sperber ..... 156/62.2
4,726,901 * 2/1988 Pall et al. ..... 210/496
5,169,700 * 12/1992 Meier et al. ..... 428/74
5,240,527 * 8/1993 Lostak et al. ..... 156/62.4
5,246,514 * 9/1993 Alderman et al. ..... 156/73.1
5,361,466 * 11/1994 Roberston et al. ..... 28/158

* cited by examiner

*Primary Examiner*—Merrick Dixon
(74) *Attorney, Agent, or Firm*—John D. Lister

(57) ABSTRACT

A tubular fibrous blanket is formed using a rotary fiberizer which produces a tow of substantially continuous thermoplastic fibers and a suction chamber with an annular, vertically extending, collection surface spaced from and surrounding the rotary fiberizer. The fibrous tow is collected on the annular, vertical collection surface or on a foraminous backing sheet passing over the collection surface in a spiral of very low pitch with succeeding portions of the tow at least partially overlapping and preferably, substantially completely overlapping preceding portions of the tow to form the tubular blanket. The tubular fibrous blanket and the backing sheet, when used, can then be slit longitudinally and unfolded to form a flat blanket having continuous fibers extending substantially perpendicular to the longitudinal axis of the blanket.

18 Claims, 2 Drawing Sheets

METHOD AND APPARATUS FOR FORMING A UNIFORM BLANKET OF SYNTHETIC OR GLASS FIBERS

BACKGROUND OF THE INVENTION

The present invention is directed to a method of and an apparatus for forming a uniform blanket of fibers and the blanket formed by the method and apparatus which is initially tubular in configuration and may be slit longitudinally and unfolded to form a blanket having fibers predominately oriented perpendicular to the longitudinal axis of the blanket.

In the manufacture of fibrous blankets using a rotary fiberization process, fibers are produced by the extrusion of a thermoplastic material, including glass and polymeric materials such as polypropylene and polyester through a large number of holes in a peripheral, annular wall of a fiberizing disc or rotor. The disc is rotated at a high rate of speed about a vertical axis causing the thermoplastic material within the disc to be extruded through the holes of the disc to form continuous fibers. The continuous fibers are issued from the holes of the disc in a substantially horizontal direction. These continuous fibers are directed downwardly toward a horizontal collection surface beneath the fiberizing disc by a substantially continuous, downwardly directed air stream which encircles the fiberizing disc. The horizontal collection surface is normally a foraminous conveyor belt passing over a suction chamber which draws air through the conveyor belt to draw the fibers onto the upper surface of the conveyor belt where a blanket of the fibers is formed. One such process of fiberization is described in connection with the manufacture of glass fibers in U.S. Pat. No. 4,058,386, issued Nov. 15, 1977, to D. H. Faulkner et al, and entitled "Method and Apparatus for Eliminating External Hot Gas Attenuation in the Rotary Fiberization of Glass (hereinafter the "386 patent"). The disclosure of this patent is hereby incorporated herein in its entirety by reference.

Several problems have been experience in the formation of fibrous blankets from substantially continuous fibers by the above referenced process. As the continuous fibers are directed downwardly toward the horizontal collection surface, the fibers twist beneath the fiberizing disc into a loosely twisted rope of fibers. In addition, the loosely twisted rope of fibers tends to snake back and forth across the moving collection surface in an irregular fashion and this results in the nonuniform, non-directional collection of the continuous fibers on the collection surface.

Accordingly, the blanket formed by this process is not uniform in thickness or density and has thin spots and/or holes which are undesirable when using the blanket as insulation or air filtration media. The problem of non-uniformity is magnified when thin blankets about one thirty-second of an inch to one inch thick are produced for air filtration or similar uses. Such blankets must have a uniform thickness and density throughout to prevent the passage of dirt or other matter through the filtration media. In addition to the above, the edges of the blanket produced by this process are irregular and this results in edge loss or scrap due to the need to trim the irregular edges from the blanket.

The blankets formed by this process are sometimes further processed by passing the blanket through a chopper to produce short length fibers (e.g. fibers from ¼ to 3 inches in length) for use in processes, such as, paper making, carding, air layering, etc. For these products, it is desired to have the short length fibers produced in the chopping operation uniform in length. With the twist imparted to the continuous fiber tow in the collection process and the irregular collection of the fibers on the collection surface to form the blanket, the orientation of the fibers in the blanket is not unidirectional. Accordingly, when the blanket is chopped to form short length fibers, the fibers vary in length and manufacturing tolerances for fiber length are difficult to maintain. Thus, it would be desirable to manufacture a blanket wherein the fibers are highly directional in their orientation to facilitate the formation of uniform length fibers in the chopping operation.

SUMMARY OF THE INVENTION

The method of the present invention forms a uniform tubular blanket of substantially continuous thermoplastic fibers. The fibers are produced on a rotary fiberizer which issues a tow of continuous thermoplastic fibers, such as polymeric or glass fibers. The tow is collected to form the tubular blanket in a low pitch spiral either directly on a vertically extending, annular collection surface surrounding the rotary fiberizer or on a foraminous backing sheet passing over the annular collection surface. Succeeding portions of the tow at least partially overlap and preferably, substantially completely overlap preceding portions of the tow as the tow is collected. The tubular blanket formed has a uniform thickness and density without thin spots or holes. In addition, the fibers of the tow remain essentially untwisted and parallel so that fibers in the blanket are directionally oriented. The tubular blanket and its foraminous backing sheet, if used, are normally slit and unfolded to form a flat blanket.

The flat blanket thus formed performs well as an air filtration media or as an insulation. The blanket is uniform in thickness having no holes or thin spots. In addition, since the lateral edges of the blanket are formed by the slitting of the tubular blanket, there is no trim loss.

The fibers of the flat blanket are not twisted and are directionally oriented extending substantially perpendicular to the longitudinal axis of the blanket. While a relatively few of the fibers may have some breakage, essentially all of the individual fibers of the blanket are continuous for and extend the width of the blanket. With its unique continuous fiber orientation, the blanket of the present invention can be further processed into short uniform length fibers by passing strips of the blanket through a conventional chopper. The strips are cut to a width that corresponds to the width of the chopper and are fed through the chopper in a direction essentially parallel to the orientation of the continuous fibers in the blanket strips. The short length fibers formed by the chopping operation are quite uniform in length.

DESCRIPTION OF THE PREFERRED EMBODIMENTS

Figure 1:
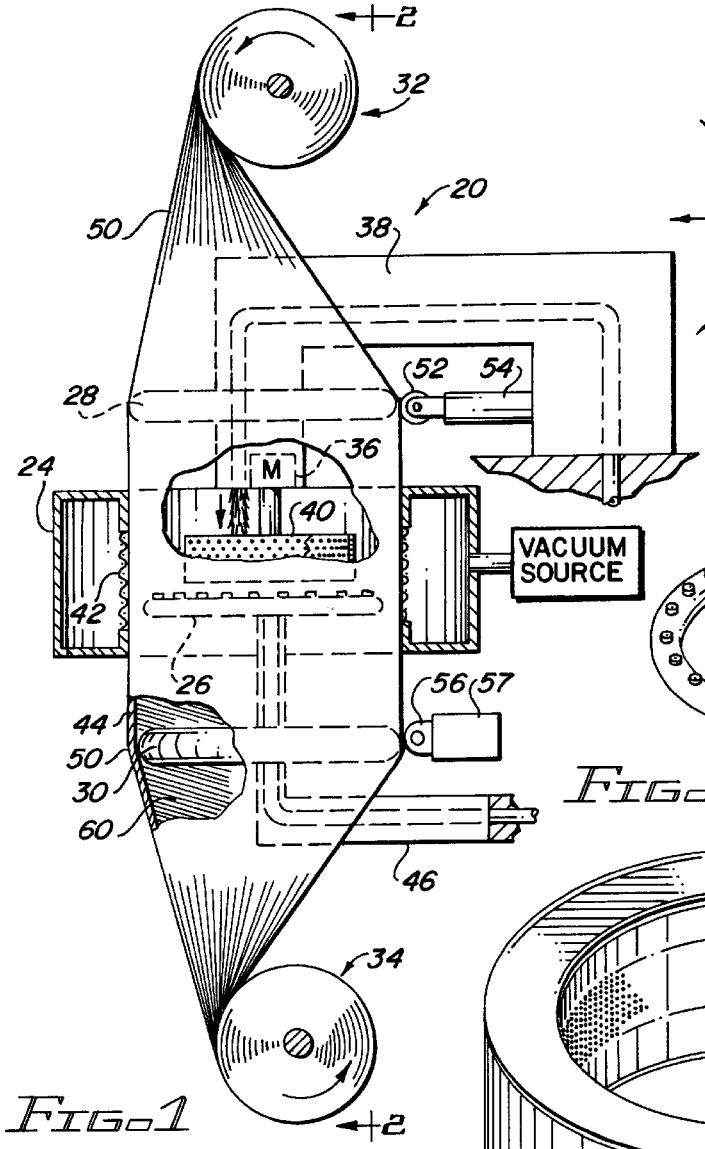
FIG. 1 is a side elevation of the apparatus of the present invention with a portion of the annular suction chamber omitted to show the fiberizing disc.
Figure 4:
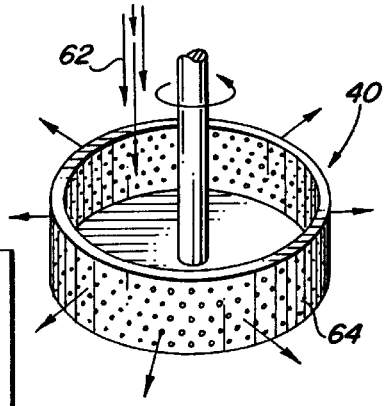
FIG. 4 is a perspective view of the fiberizing disc.
Figure 5:
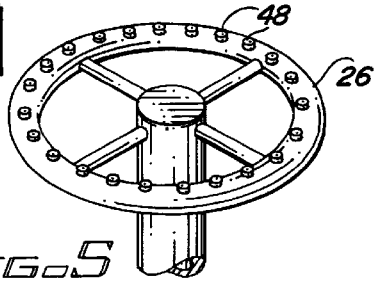
FIG. 5 is a perspective view of the binder application ring.
Figure 6:
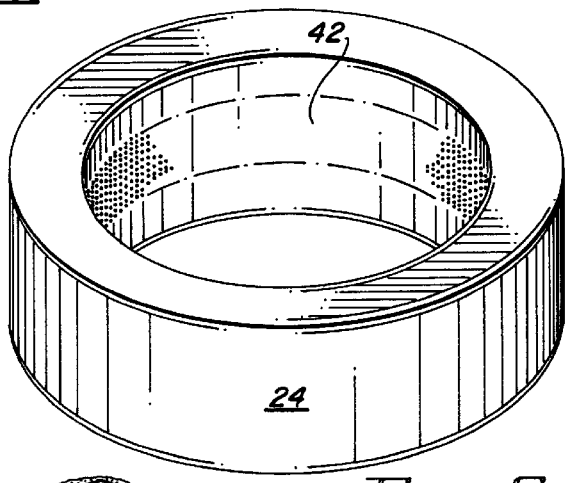
FIG. 6 is a perspective view of the annular suction chamber.
Figure 3:
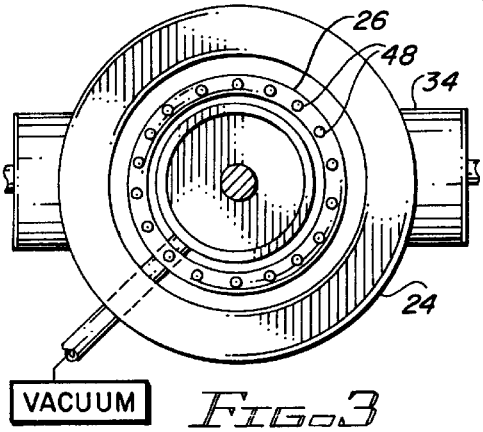
FIG. 3 is a top view taken substantially along lines 3—3 of FIG. 1.

The apparatus 20 of the present invention is shown in FIGS. 1–3 and 11. The apparatus 20 comprises a rotary fiberizing unit 22, an annular suction chamber 24, a binder application ring 26, forming rings 28 and 30, a backing sheet supply roll 32 and a blanket wind-up 34.

The rotary fiberizing unit 22 comprises a drive motor 36, a cantilevered fiberizing disc support 38 and a fiberizing disc 40. When glass is being fiberized, a rotor or fiberizing disc heater unit, such as disclosed in the '386 patent, can be used to maintain the glass within the fiberizing disc and the area immediately adjacent the fiberizing disc at the proper temperature for fiberization of the glass. When a polymeric material is being fiberized, the polymeric material and the area adjacent the fiberizing disc is maintained at the proper temperature for fiberizing the polymeric material by the use of hot air, preferably heated by gas combustion and having a low oxygen content to minimize oxidation of the organic material. Since the drive motor 36 and the drive train of the fiberizing disc are conventional, these components are not shown in detail to better illustrate the overall relationship of the apparatus components. The cantilevered fiberizing disc support 38 employs a conventional framework for supporting the fiberizing disc 40.

The fiberizing disc 40, which can be of the type disclosed in the '386 patent, has thousands of small diameter holes in an annular sidewall and is rotated at several thousand revolutions per minute i.e. between 2,500 and 12,000 rpm. The fiberizing disc can be about two feet in diameter and have a sidewall about two and one-half inches high. A thermoplastic material 62, such as, glass or a polymeric material, is deposited within the fiberizing disc 40 and extruded out through the holes 64 in the sidewall of the disc to form thousands of continuous microfibers having diameters ranging from about 0.4 to about 20 microns. The continuous microfibers are projected outwardly from the fiberizing disc in a substantially horizontal direction as a tow 60.

The annular suction chamber 24 encircles the fiberizing disc 40 and for a fiberizing disc two feet in diameter, the inner diameter of the suction chamber is about three feet. Thus, the spacing between the fiberizing disc and the collection surface 42 of the suction chamber is about six inches. With a fiberizing disc having a two and one-half inch high sidewall, the inner annular surface is typically about fourteen inches high. The central seven inch portion of the inner annular surface is positioned directly opposite the sidewall of the fiberizing disc 40, is foraminous, and forms the collection surface 42 of the annular suction chamber. The annular suction chamber is connected to a conventional suction fan (not shown) which creates a partial vacuum within the annular suction chamber and draws air into the chamber through the foraminous collection surface 42. The flow of air into the annular suction chamber through the foraminous collection surface 42 draws the tow toward the collection surface where the tow is collected to form a tubular blanket 44 either directly on the annular collection surface 42 or on a foraminous backing sheet 50 passing over the collection surface.

The tubular blanket 44 of the present invention can be formed of glass fibers and/or glass microfibers or polymeric fibers and/or polymeric microfibers such as polypropylene, polyethylene, nylon or polyester fibers. The tubular blanket 44 comprises three embodiments with or without a foraminous backing sheet 50. The backing sheet 50 is normally a spunbonded backing sheet material such as, a polyester backing sheet like REMAY fabric or CEREX fabric.

In a first embodiment, layers of the tow 60 of continuous thermoplastic fibers are collected to form the tubular blanket without bonding the continuous fibers together. In this embodiment, succeeding portions of the tow are collected in layers on preceding portions of the tow to form the tubular blanket 44.

In a second embodiment, the temperature of the space between the fiberizing disc 40 and the annular collection surface 42 is maintained at a level which keeps the continuous fibers of the tow 60 tacky on their surface as they are collected to form the tubular blanket 44. Thus, succeeding portions of the continuous fibers in succeeding portions of the tow are directly bonded to preceding portions of the continuous fibers in preceding portions of the tow as the succeeding layers of tow are collected on preceding layers of the tow to form the tubular blanket 44.

In a third embodiment, a resinous binder or other suitable binder is applied to the tow 60 as it passes from the fiberizing disc 40 toward the collection surface 42. Thus, as succeeding layers of the tow are collected on preceding layers of the tow, succeeding portions of the continuous fibers of the tow are bonded by the binder to preceding portions of the continuous fibers in preceding layers of the tow to form the tubular blanket 44.

As shown in FIGS. 1–3 and 11, the binder application ring 26 is located just beneath the fiberizing disc 40 and is supported by a cantilevered support 46 of conventional construction. A pressurized liquid binder, such as, a resinous bonding agent, is supplied to the binder application ring 26 through the cantilevered support 46. The binder application ring 26 is about thirty inches in diameter and is provided with a plurality of upwardly directed spray nozzles 48 for applying the binder to the continuous fibers of the tow as the tow of continuous fibers is drawn from the fiberizing disc 40 toward the collection surface 42 of the annular suction chamber.

Figure 11:
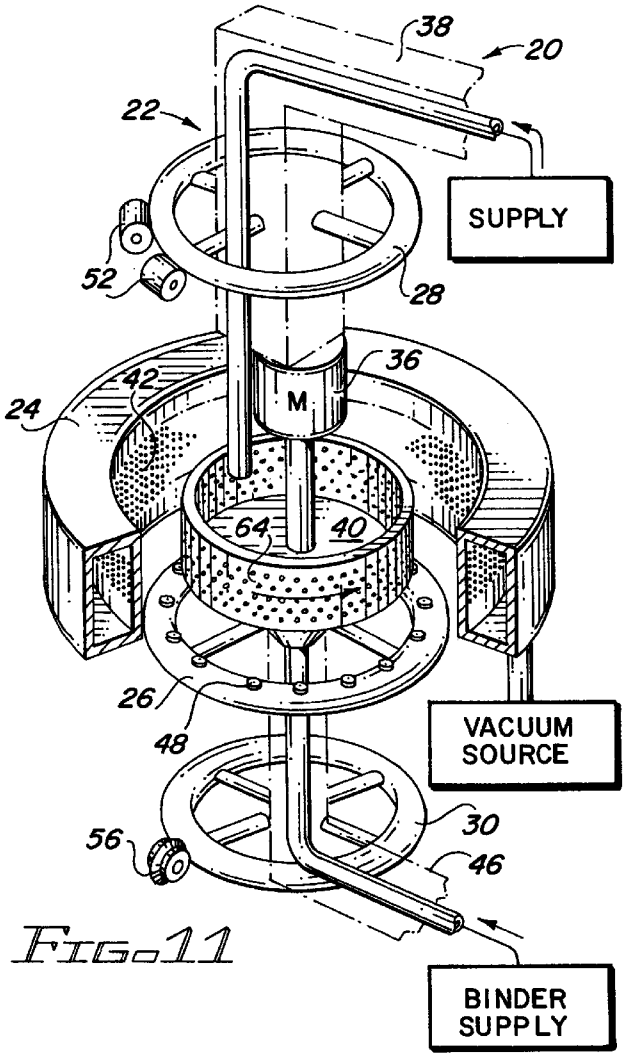
FIG. 11 is a perspective view of the apparatus of the present invention, with portions broken away and no backing sheet passing through the apparatus, to better show the components of the apparatus.
Figure 2:
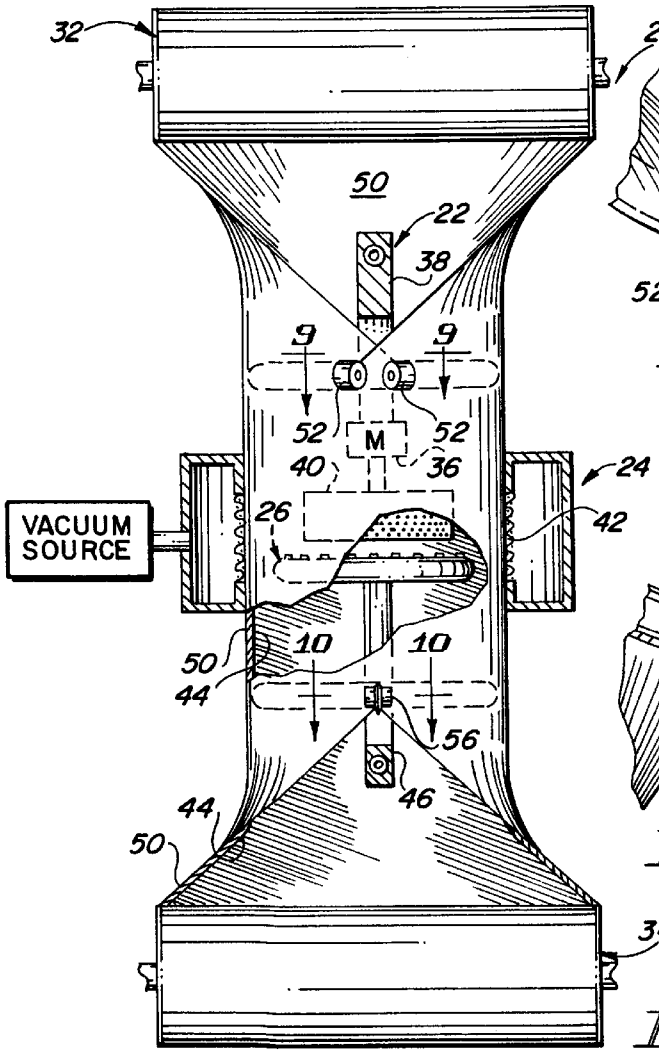
FIG. 2 is a front elevation of the apparatus of the present invention with a portion of the annular suction chamber, the cantilevered fiberizer support and the drive omitted for clarity.

As best shown in FIGS. 1, 2 and 11, the forming rings 28 and 30 are supported by the cantilevered fiberizing disc support 38 and the cantilevered binder application ring support 46 respectively. The tubular forming ring 28 functions to form the foraminous backing sheet 50 from the supply roll 32 into a tubular configuration and to guide the tubular foraminous backing sheet down between the fiberizing disc 40 and the annular collection surface 42 of the annular suction chamber. The outside diameter of the forming ring 28 is substantially equal to the inside diameter of the annular suction chamber. Accordingly, the tubular foraminous backing sheet 50, formed by passing the backing sheet over the forming ring 28, passes over the collection surface 42 of the annular suction chamber 24.

Figure 9:
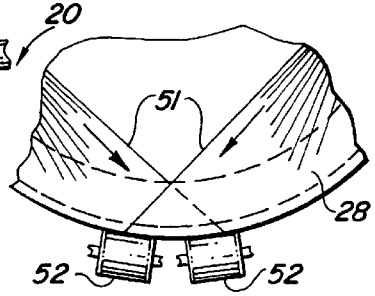
FIG. 9 is a top view of the upper forming ring and the rollers for overlapping the lateral edges of the backing sheet to form a tube.

As shown in FIGS. 1, 2 and 9, as the foraminous backing sheet 50 is formed into a tubular configuration by passing the sheet over the forming ring 28, the lateral edges 51 of the foraminous backing sheet are overlapped. The overlapped edges of the foraminous backing sheet 50 pass between and are held in overlapping relationship by the tubular forming ring 28 and rollers 52 which are urged against the forming ring 28 by a pneumatic cylinder 54. The rollers 52 can be resistance heated or otherwise heated to thermally bond the edges 51 of the backing sheet together at the forming ring 28 as the edges pass between the rollers and the annular forming ring. It is also contemplated that the overlapping edges of the foraminous backing sheet 50 can be secured together by applying an adhesive to the edges as the overlapping edges pass between the rollers 52 and the forming ring 28 and while not specifically shown, it is contemplated that the overlapping edges of the foraminous backing sheet can be secured together by stitching the edges together as the overlapping edges pass from between the rollers and the annular forming ring 28.

Figure 10:
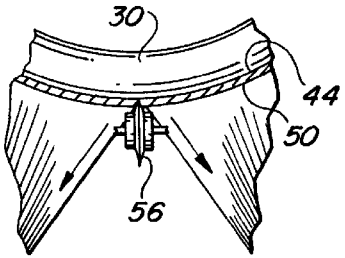
FIG. 10 is a top view of a portion of the lower forming ring and the ultrasonic slitting wheel.

The annular forming ring 30, shown in FIGS. 1, 2 and 10, guides the tubular blanket 44 and the backing sheet 50, when used, downstream of the fiberizing and collection portion of the apparatus 20. The annular forming ring 30, in cooperation with the annular forming ring 28, assures that the blanket 44 and backing sheet 50, when used, are maintained in a tubular configuration for the formation of the tubular blanket 44. The forming ring 30 also cooperates with an ultra sonic slitting wheel 56 to longitudinally slit the blanket 44 and the backing sheet 50. The ultrasonic wheel, which is pressed against the forming ring 30 by the pneumatic cylinder 57, vibrates at a high frequency generating heat which melts and severs the fibers of the blanket and the backing sheet. Branson Ultrasonics Corp. of Danbury Conn., markets ultrasonic slitting wheels which can be used for slitting the blanket 44 of the present invention.

After the blanket 44 is slit, the blanket is unfolded into a flat blanket 58 and wound into a roll on the blanket wind-up assembly 34. The wind-up assembly 34 is a conventional driven wind-up assembly which also functions to pull the blanket 44, with or without a backing sheet 50, through the apparatus 20.

After the process is initiated, the tubular blanket 44 of the present invention can be made with or without the foraminous backing sheet 50. When the process is initiated, the foraminous backing sheet 50 is passed over the forming ring 28 and formed into the tubular configuration with overlapping lateral edges 51. The tubular backing sheet 50 is next passed down between the rotary fiberizing disc 40 and the annular suction chamber 24 passing over the annular collection surface 42 of the suction chamber where the tow 60 is collected on the backing sheet to form the tubular blanket 44. The tubular blanket 44 and backing sheet 50 are then passed over the forming ring 30 where the blanket and backing sheet are normally cut and unfolded from a tubular configuration into a flat blanket 58 which is wound onto the driven wind-up assembly 34. When the blanket 44 being produced requires a backing sheet, the backing sheet continues to be fed into the process from the supply roll or rolls 32 until the production run is completed. When the blanket 44 being produced does not require a backing sheet, the backing sheet 50 is used only to initiate the manufacturing process and is no longer used once the blanket 44 can be pulled through the apparatus 20 by the wind-up 34.

In the production of a blanket 44, a molten thermoplastic material 62, such as, glass or a polymeric material, is delivered from a suitable source (not shown) such as, a forehearth or other conventional glass or polymeric material melting and refining means, to the fiberizing disc 40. The fiberizing disc 40 and the surrounding space intermediate the fiberizing disc and the collection surface 42 of the annular suction chamber are maintained at the appropriate temperature for fiberization of the glass of polymeric material.

As the fiberizing disc 40 is rotated at several thousand revolutions per minute, the molten thermoplastic material within the disc is extruded through the thousands of holes 64 in the peripheral sidewall of the disc to form a tow of continuous filaments. The tow 60 of fibers is projected substantially horizontally from the fiberizing disc. As air is drawn into the annular suction chamber 24 through the foraminous collection surface 42 or through the foraminous backing sheet 50, when used, and the foraminous collection surface 42, the tow of continuous fibers is drawn toward the collection surface and is deposited directly on the foraminous collection surface or, when used, on the foraminous backing sheet 50 to form the tubular blanket 44.

The rate of cooling of the continuous fibers issued from the fiberizing disc 40 is controlled by controlling the temperature of the ambient air being drawn by the annular suction chamber 24 into the space between the fiberizing disc and the annular suction chamber. When the continuous fibers in the tow forming the blanket 44 are not to be thermally bonded together, the ambient air being drawn by the annular suction chamber into the space between the fiberizing disc and the annular suction chamber is maintained at a temperature to cool the fiber surfaces below the softening point of the thermoplastic material forming the fibers so that the surfaces of the fibers are no longer tacky when the fibers are collected to form the blanket. Thus, the continuous fibers do not become bonded directly together in the blanket.

When the continuous fibers in the tow forming the blanket 44 are to be thermally bonded together, the ambient air being drawn by the annular suction chamber into the space between the fiberizing disc and the annular suction chamber is maintained at a temperature to keep the fiber surfaces above the softening point of the thermoplastic material forming the fibers so that the surfaces of the fibers will be tacky when the fibers are collected to form the blanket 44. Thus, the fibers become thermally bonded together at their points of contact and/or intersection when the surfaces of the fibers cool. The temperature of the ambient air can be controlled by cooling the air directed into the space between the fiberizing disc 40 and the annular suction chamber 24 with a conventional industrial air conditioning system and by heating the air directed into the space between the fiberizing disc 40 and the annular suction chamber 24 by conventional gas combustion heaters.

As the tow 60 of continuous fibers passes from the fiberizing disc toward the collection surface 42, a binder can be applied to the tow from the binder application ring 26 when is it desired to produce a blanket having more integrity. The binder is sprayed up into the area between the fiberizing disc and the collection surface 42 by the spray nozzles 48 coating the continuous fibers as the continuous fibers pass from the fiberizing disc to the blanket. The binder can cure under ambient conditions or if required, the blanket 58 can be passed through a conventional convection heated oven to cure the binder.

The foraminous backing sheet 50 and/or the blanket 44 is pulled over the collection surface by the wind-up assembly 34 at between ten and one hundred feet per minute. Since the fiberizing disc is rotating a several thousand revolutions per minute, succeeding portions of the tow substantially completely overlap and are collected on preceding portions of the continuous tow. Thus, while the tow is collected in a spiral to form the blanket 44, the spiral has an extremely low pitch.

Since the tow 60 of continuous fibers is collected on a collection surface located radially outward and opposing the sidewall of the fiberizing disc and the tow is collected in a very low pitch spiral, the tow remains untwisted and the fibers of the tubular blanket 44 are highly, directionally oriented in a substantially circumferential direction within the blanket. The thickness of the tubular blanket 44 formed is determined by the output of the fiberizing disc and the speed with which the tubular blanket is pulled through the apparatus. When no backing sheet is being used and the blanket is being formed directly on the collection surface 42, the blanket must be thick enough to have the integrity required to be pulled through the apparatus 20 by the wind-up 34 without separating or pulling apart. At a particular thickness, the suction of the air into the annular suction chamber 24 through the blanket is not great enough to draw the tow onto the surface of the blanket being formed. At this point, the tow spirals down below the fiberizing disc and becomes wrapped about the fiberizing disc. The process then has to be interrupted to clear the entangled tow from the disc. Thus, the tubular blanket 44 formed by the process of the present invention can not exceed that thickness at which the air flow through the blanket (including the backing sheet when used) into the suction chamber is sufficient to draw the tow onto the blanket surface for collection.

After the tubular blanket 44 is formed on the annular collection surface 42 or on the foraminous backing sheet 50 as the backing sheet is pulled over the collection surface, the blanket passes over the forming ring 30. As the tubular blanket 44 passes over the forming ring 30, the tubular blanket with its backing sheet, when used, is slit longitudinally by the ultrasonic slitting wheel 56. Since the ultrasonic slitting wheel melts and severs the continuous fibers, no dust is created by the slitting process and the lateral edges of the flat blanket 58 formed from the tubular blanket 44 are sealed or encapsulated. After the tubular blanket 44 is slit, the tubular blanket 44 is unfolded and wound into a roll on the blanket wind-up 34.

Figure 7:
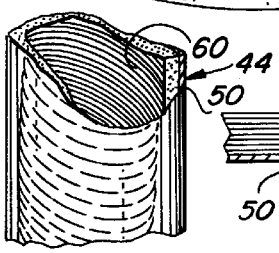
FIG. 7 shows the tubular blanket of the present invention with a portion of the blanket and its backing sheet broken away to show the spiral tow of fibers forming the tubular blanket.

FIG. 7 shows the tubular blanket 44 with its backing sheet 50. A portion of the tubular blanket is broken away to show the spiral layers of continuous fiber tow 60 which form the tubular blanket. The spiral is exaggerated for illustrative purposes. However, as discussed above, with the fiberizing disc rotating between 2,500 and 12,000 revolutions per minute and with the blanket moving over the collection surface 42 at about ten to one hundred feet per minute, the continuous fiber tow 60 extends in a substantially circumferential direction within the tubular blanket with a spiral pitch that is extremely low. As discussed above, the layers of continuous fiber tow in the blanket may not be bonded together; the layers of continuous fiber tow may be directly bonded together through thermal bonding; or the continuous fiber tow may be indirectly bonded together through the use of a binder when the blanket requires more integrity.

Figure 8:
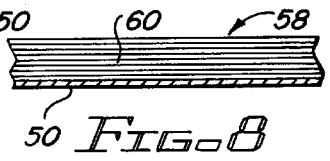
FIG. 8 is a transverse section of the flat blanket of the present invention.

The flat blanket 58 is shown in FIG. 8 with a backing sheet 50. Since FIG. 8 is a section perpendicular to the longitudinal centerline of the flat blanket 58, the continuous fibers of the tow 60 in the blanket are shown extending across the width of the blanket. Since the continuous fibers are highly, directionally oriented, the processing of strips of the blanket 58 in a chopper, to produce short length fibers, produces fibers which are very uniform in length.

In describing the invention, certain embodiments have been used to illustrate the invention and the practices thereof. However, the invention is not limited to these specific embodiments as other embodiments and modifications within the spirit of the invention will readily occur to those skilled in the art on reading this application. Thus, the invention is not intended to be limited to the specific embodiments disclosed, but is to be limited only by the claims appended hereto.

What is claimed is:

1. A method of forming a fibrous blanket comprising:

providing a foraminous backing sheet; forming said foraminous backing sheet into a tubular foraminous backing sheet;

passing said tubular foraminous backing sheet between a rotary fiberizer for producing fibers and an annular suction chamber encircling said rotary fiberizer;

producing fibers with said rotary fiberizer; and forming a tubular blanket of said fibers on an inner surface of said tubular foraminous backing sheet by drawing air into said annular suction chamber through said tubular foraminous backing sheet to thereby draw said fibers toward said tubular foraminous backing sheet and collect said fibers on said inner surface of said tubular foraminous backing sheet.

2. The method of claim 1, wherein: said fibers are substantially continuous thermoplastic fibers.

3. The method of claim 1, including: slitting said tubular blanket and said tubular foraminous backing sheet longitudinally, and opening said tubular blanket and said tubular foraminous backing sheet to form a flat blanket.

4. The method of claim 1, including: applying a bonding agent to said fibers prior to the collection of said fibers on said tubular foraminous backing sheet to bond said fibers together and to bond said fibers to said tubular foraminous backing sheet at an interface between said tubular blanket and said tubular foraminous backing sheet; and curing said bonding agent.

5. The method of claim 4, including: slitting said tubular blanket and said tubular foraminous backing sheet longitudinally; and opening said tubular blanket and said tubular foraminous backing sheet to form a flat blanket.

6. The method of claim 5, wherein: said fibers are continuous thermoplastic fibers.

7. The method of claim 2, including: maintaining surfaces of said fibers at a temperature above the softening point of said fibers until the collection of said fibers on said tubular foraminous backing sheet whereby said surfaces of said fibers are tacky and bond to each other and to said tubular foraminous backing sheet at an interface between said tubular blanket and said tubular foraminous backing sheet.

8. The method of claim 7, including: slitting said tubular blanket and said tubular foraminous backing sheet longitudinally; and opening said tubular blanket and said tubular foraminous backing sheet to form a flat blanket.

9. The method of claim 7, wherein: said fibers are glass fibers.

10. The method of claim 7, wherein: said fibers are polymeric fibers.

11. The method of claim 2, including: reducing the temperature of surfaces of said fibers below the softening point of said fibers prior to collection of said fibers on said tubular foraminous backing sheet.

12. The method of claim 2, including: collecting said continuous fibers as a tow on said tubular foraminous backing sheet in a low pitch spiral with succeeding portions of said tow substantially, completely overlapping preceding portions of said tow to form said tubular blanket.

13. The method of claim 12, including: slitting said tubular blanket and said tubular foraminous backing sheet longitudinally; and opening said tubular blanket and said tubular foraminous backing sheet to form a flat blanket having continuous fibers extending substantially perpendicular to a longitudinal axis of said flat blanket.

14. The method of claim 13, including: applying a bonding agent to said continuous fibers prior to the collection of said continuous fibers.

15. The method of claim 13, including: maintaining surfaces of said continuous fibers at a temperature above the softening point of said continuous fibers until the collection of said continuous fibers.

16. The method of claim 13, including: reducing the temperature of surfaces of said continuous fibers below the softening point of said continuous fibers prior to the collection of said fibers.

17. The method of claim 13, wherein: said continuous fibers are glass fibers.

18. The method of claim 13, wherein: said continuous fibers are polymeric fibers.

* * * * *